United States Patent [19]

Toivonen et al.

[11] 3,972,210

[45] Aug. 3, 1976

[54] CYLINDER LOCK

[75] Inventors: Pentti Toivonen; Esko Tyynelä, both of Joensuu, Finland

[73] Assignee: Oy Wartsila AB, Helsinki, Finland

[22] Filed: Sept. 25, 1975

[21] Appl. No.: 616,891

[52] U.S. Cl. ..... 70/366; 70/377

[51] Int. Cl.[2] ..... E05B 15/14

[58] Field of Search ..... 70/366, 365, 377, 364 R, 70/DIG. 28

[56] References Cited

UNITED STATES PATENTS

| | | | |
|---|---|---|---|
| 2,524,339 | 10/1950 | Young | 70/366 |
| 3,681,956 | 8/1972 | Niilole | 70/366 |
| 3,848,442 | 11/1974 | Mertanen | 70/366 |

FOREIGN PATENTS OR APPLICATIONS

| | | | |
|---|---|---|---|
| 266,856 | 2/1950 | Switzerland | 70/366 |

*Primary Examiner*—Robert L. Wolfe

*Attorney, Agent, or Firm*—Haseltine, Lake & Waters

[57] ABSTRACT

A disc cylinder lock comprising a turnable cylinder enclosing a plurality of locking discs, turnable by the key of the lock, and between adjacent locking discs, intermediate discs. The intermediate discs are radially larger than the locking discs and are provided on one side with an axially extending edge portion defining a cup-formed space on one side of the intermediate disc, the opposite side of the disc being its bottom side. In the lock, the axially extending edge portion contacts the bottom side of an adjacent intermediate disc, so that the last mentioned bottom side forms a cover on the cup-formed space, thereby providing a substantially closed space for each locking disc, located between two adjacent intermediate discs. In this space the locking disc can move without being subject to axial load.

4 Claims, 2 Drawing Figures

CYLINDER LOCK

Figure 2:
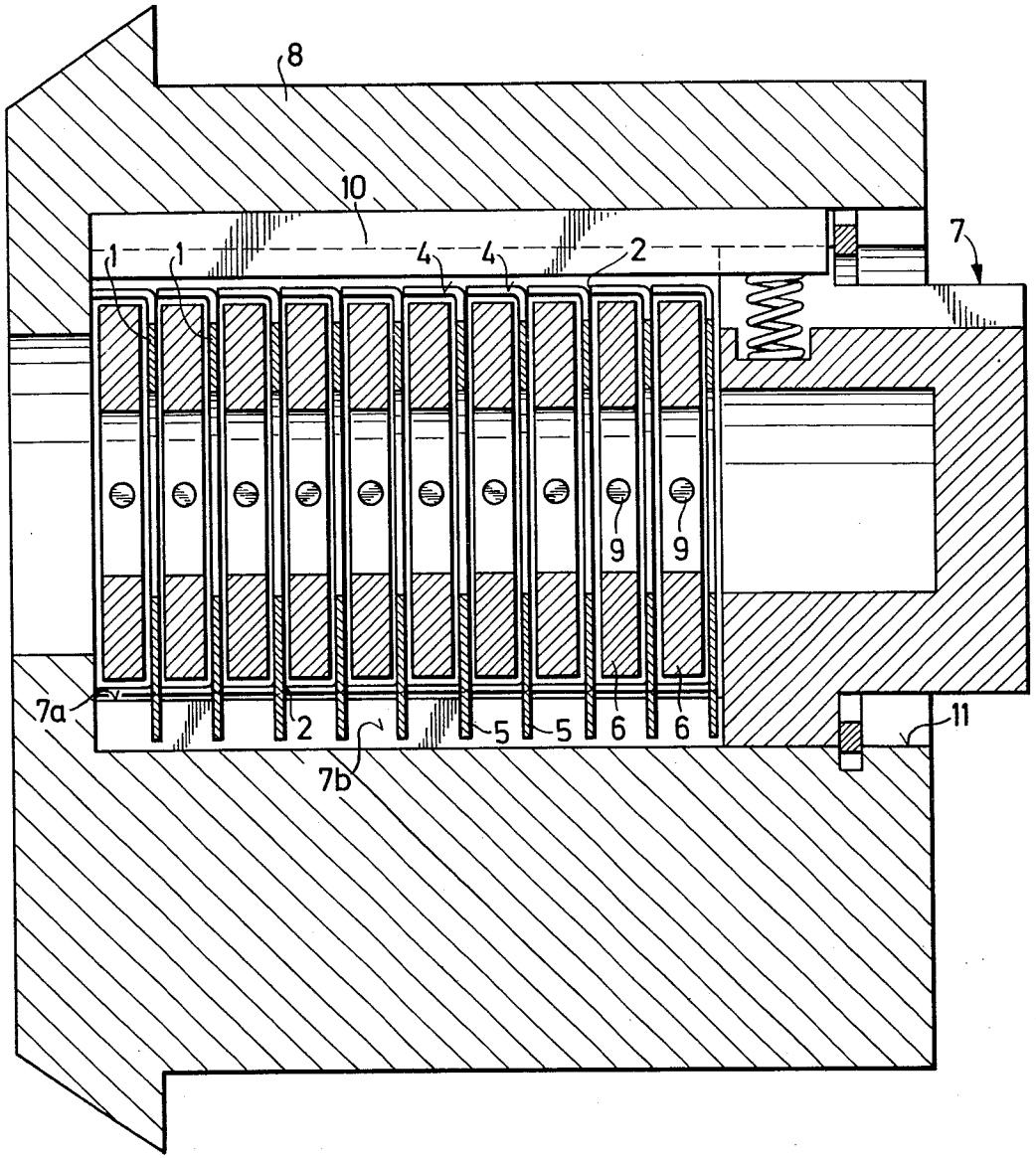

The invention relates to a cylinder lock, which comprises a turnable cylinder enclosing a plurality of locking discs turnable by the key of the lock, and between adjacent locking discs intermediate discs.

In a disc cylinder lock with turning locking discs, it is essential that the movement of a locking disc is not transferred from one locking disc to another by means of friction, because this could easily cause malfunction. In a disc cylinder lock with radially movable locking discs, each locking disc is usually placed in a separate slot where it can move free from contact with other locking discs. This solution cannot be used in a disc cylinder lock with turnable locking discs, instead non-turnable intermediate discs are provided. The intermediate discs prevent adjacent locking discs from touching each other but do not prevent axial load from being transferred from one locking disc to another. Consequently, a locking disc may get jammed because there is too great an axial load. There are some kinds of lock, in which the transfer of an axial load from one locking disc to another is of particular disadvantage. One is a so called push-key lock, in which turnable locking discs are turned into a cylinder releasing position by an irregularly curved groove in the key when the key is axially pushed into the lock. Another lock type sensitive to axial load is a lock with spring means for bringing the locking discs back to their initial position.

An object of the invention is to create a disc cylinder lock, in which a space is formed for each locking disc in a new and simple manner. In this space, the locking disc can move without touching other locking discs and without transferring axial load to other locking discs or receiving axial load from other locking discs.

It is, for instance, very important to solve this problem in said push-key lock, because so far the function of this kind of lock has not been satisfactory, because the innermost locking discs have been loaded with the axial load of all the locking discs in front of them, whereby a substantial frictional drag has been produced. The problem is slightly different in locks, where the locking discs have spring returning means, because in this kind of lock the mechanism itself does not produce any axial load. On the other hand, the preservation of a sensitive movability of the locking discs is of great importance, because otherwise the relatively weak spring returning means may fail in returning the locking discs.

According to the invention the intermediate discs are radially larger than the locking discs, and are provided on one side with an axially extending edge portion defining a cup-formed space on one side of the intermediate disc, the opposite side of the disc being its bottom side. In the lock, the axially extending edge portion contacts the bottom side of an adjacent intermediate disc, so that the last mentioned bottom side forms a cover on said cup-formed space, thereby providing a substantially closed space for each locking disc, located between two adjacent intermediate discs. In this space, the locking disc can move without loading other locking discs in the axial direction of the lock. With this kind of lock the object of the invention is achieved in a very simple way. An intermediate disc provided with an axially extending edge portion can easily be made of the usual material for locking discs, that is, brass plate, about 0.2 mm in thickness.

Depending on the function and the construction of the lock, the turnable cylinder of the lock is normally provided with one or several openings in its cylindrical surface, usually in the form of axial slots, to allow certain members of the lock mechanism to cooperate. For instance, the locking member of the lock has to be in contact with the locking discs through the turnable cylinder, and usually also the side surfaces of another axial slot in the cylinder are used for restricting the rotation of the locking discs of the lock or for preventing turning of the intermediate discs or some of the locking discs. The intermediate discs of a lock according to the invention should preferably have their axially extending edge portion interrupted at the portions where the surrounding cylinder has openings in its cylindrical surface, so that the axially extending edge portion of the intermediate discs does not prevent cooperation between different parts of the lock. This is not, however, the only solution. In some cases it is also possible to locate the axially extending edge portion further radially outwards, for instance, so that it is level with the outer surface of the turnable cylinder. This is possible within a slot or opening, where the side surfaces of the opening are used as movement restricting surfaces with respect to the locking discs and the intermediate discs.

Figure 1:
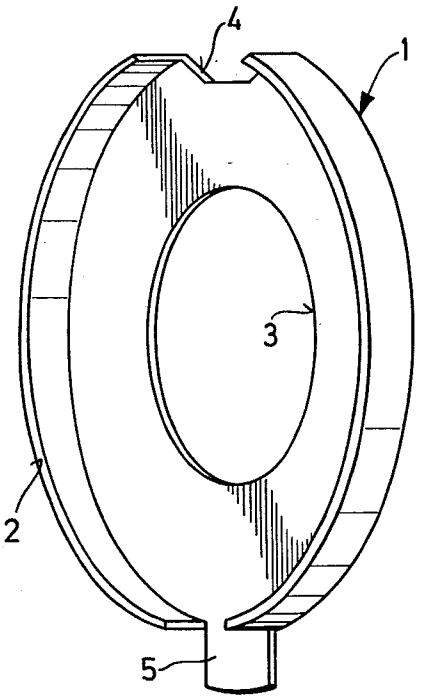

In the following, the invention is described in greater detail with reference to the accompanying drawing, in which:

FIG. 1 shows a perspective view of an intermediate disc of a lock according to the invention and FIG. 2 shows schematically, in axial section, a lock according to the invention.

In the drawing, 1 indicates an intermediate disc and 2 an axially extending portion thereof. In the middle of the intermediate disc, there is an opening 3 for the key of the lock. If the intermediate disc is in such a lock, in which an axial locking bar 10 locks the turnable locking cylinder 7, there has to be a notch 4 in the intermediate disc in order to enable the locking bar 10 to move into a position releasing the locking cylinder 7. Usually, the intermediate discs should not be turnable relatively the cylinder 7, and consequently, the intermediate disc shown in FIG. 1 has a projection 5 which fits into an axial slot **7*b* provided in the locking cylinder 7. This projection is made by leaving one portion of the edge unbent when forming the axially extending portion 2**.

FIG. 2 shows how the intermediate discs 1 jointly form a number of closed spaces of which each encloses a locking disc 6. The locking discs and the intermediate discs are enclosed in a boring **7*a* in the locking cylinder 7 and the locking cylinder 7, in turn, is enclosed in a boring 11 in the outer cylinder 8**.

The type of lock shown in FIG. 2 can be, as to its basic functional principle, of the kind shown in Swedish Pat. No. 329 104, hereby incorporated by reference. In such a lock, the locking discs 6 are turned to a cylinder-releasing position when the key is axially inserted in the lock, because the key is provided with an irregularly curved groove, which engages a radially inwards extending pin 9 of each of the locking discs 6. The greatest disadvantage in this kind of lock, is, that the key produces an axial load on each of the locking discs, and this load is transferred from one locking disc to another so that the innermost of the locking discs will be subject to a very great axial load producing a substantial frictional drag. If intermediate discs according to the invention are used in this kind of lock, the axial load is not transferred from one locking disc to another, and hence, remains relatively small also at the innermost locking discs so that all the locking discs can be turned without any substantial frictional drag.

The invention may also advantageously be applied to a lock according to U.S. Pat. No. 3.789.638, hereby incorporated by reference. In this kind of lock, the locking discs have a spring returning means and, hence, it is very important that all the locking discs move easily.

The invention is not restricted to the embodiments described but several modifications are feasible within the scope of the attached claims.

We claim:

1. A disc cylinder lock comprising a turnable cylinder enclosing a plurality of locking discs, turnable by the key of the lock and between adjacent locking discs, intermediate discs, said intermediate discs being radially larger than said locking discs, and being provided on one side with an axially extending edge portion defining a cup-formed space on one side of said intermediate disc, the opposite side of the disc being its bottom side, said axially extending edge portion contacting the bottom side of an adjacent intermediate disc, said last mentioned bottom side forming a cover on said cup-formed space, thereby providing a substantially closed space for each locking disc, located between two adjacent intermediate discs.

2. A lock according to claim 1, in which said axially extending edge portion is interrupted at portions where said turnable cylinder is provided with openings in its cylindrical surface.

3. A lock according to claim 1, in which said key is provided with a locking disc turning surface, said surface being arranged to engage said locking discs and to turn them into a cylinder releasing position when said key is pushed into said lock.

4. A lock according to claim 1, in which said intermediate discs are provided with a radially extending projection being made by leaving one portion of the edge of the intermediate disc unbent when forming said axially extending edge portion.

* * * * *

UNITED STATES PATENT OFFICE

CERTIFICATE OF CORRECTION

Patent No. 3,972,210 Dated August 3, 1976

Inventor(s) Pentti Toivonen et al.

It is certified that error appears in the above-identified patent and that said Letters Patent are hereby corrected as shown below:

On the Title Page, Item [30] should read

Findland 2826 September 24, 1974.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*